United States Patent [19]

Nelson

[11] 4,111,314

[45] Sep. 5, 1978

[54] TRANSPORTABLE SILO

[75] Inventor: Richard L. Nelson, Princeton, Ill.

[73] Assignee: Walnut Sand & Gravel Co., Princeton, Ill.

[21] Appl. No.: 797,993

[22] Filed: May 18, 1977

[51] Int. Cl.[2] ..... B65G 65/40

[52] U.S. Cl. ..... 214/17 A; 52/194; 214/515

[58] Field of Search ..... 214/17 R, 17 A, 2, 501, 214/515; 52/192, 194, 119, 120

[56] References Cited

U.S. PATENT DOCUMENTS

| | | | |
|---|---|---|---|
| 2,567,795 | 9/1951 | Woolslayer et al. | 52/120 |
| 2,756,881 | 7/1956 | Sims | 214/2 |
| 3,142,390 | 7/1964 | Preeman | 214/2 X |
| 3,275,298 | 9/1966 | Hand | 214/515 |
| 3,792,790 | 2/1974 | Brubaker | 214/501 |
| 3,945,619 | 3/1976 | Taibi | 214/2 X |
| 4,026,441 | 5/1977 | Jones | 214/501 X |

*Primary Examiner*—Albert J. Makay

*Attorney, Agent, or Firm*—Polster, Polster and Lucchesi

[57] ABSTRACT

A transportable silo assembly is provided which includes a self-supporting structure with a platform with an opening in it, pillow blocks mounted on the platform, trunions journaled in the pillow blocks, a silo mounted on the trunions for pivotal movement between an erected position and a lowered transport position, a winch mounted on the structure, a cable so arranged as to move the silo between erected and transport position upon operation of the winch, and structures on the leading and trailing ends of the self-supporting structure by which wheels can be mounted and demounted, whereby the self-supporting structure can be transported.

5 Claims, 7 Drawing Figures

TRANSPORTABLE SILO

BACKGROUND OF THE INVENTION

This invention relates to silos of the type from which bulk materials such as gravel, sand and asphalt are dispensed into a dump truck below it. Heretofore, it has been common either to fabricate such a silo from its various components at the scene of a construction project or at least partly to dismantle a silo when it is to be moved from place to place.

One of the objects of this invention is to provide a large silo which can be moved easily from place to place in its essentially assembled condition.

Another object is to provide such a silo which is simple, rugged and inexpensive to manufacture and use.

Other objects will become apparent to those skilled in the art in the light of the following description and accompanying drawing.

SUMMARY OF THE INVENTION

In accordance with this invention, generally stated, a transportable silo assembly is provided which comprises a self-supporting structure including spaced supporting posts and a platform connected to and supported by the posts. The platform has laterally spaced side members and longitudinally spaced end members which define an opening in the platform. Bearing means are mounted on the side members and trunions are jounaled in the bearing means. A silo, mounted on the trunions is positioned and arranged for pivotal movement between an erected position and a lowered, transport position at least partly within the opening. Means are mounted on the structure for moving the silo between erected and lowered position, and means are provided for selectively mounting the entire structure on and demounting the structure from wheels, whereby the entire silo assembly can be transported.

DESCRIPTION OF THE PREFERRED EMBODIMENT

Figure 1:
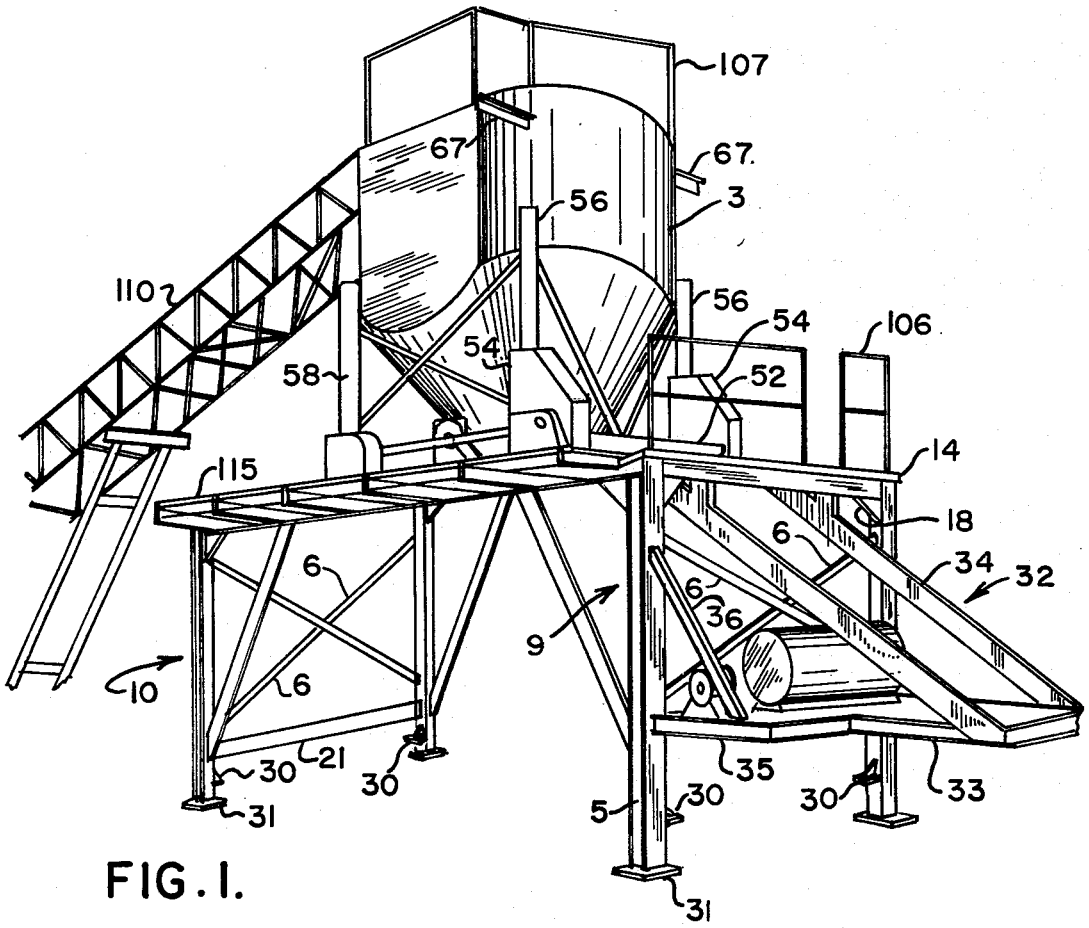
FIG. 1 is a view in perspective of one illustrative embodiment of silo assembly of this invention, in operating condition.

Referring now to the drawing, reference numeral 1 indicates a silo assembly of this invention made up broadly of a supporting structure 2 and a silo 3.

The supporting structure includes four heavy posts 5, end pairs of which are connected by diagonal cross braces 6. The posts 5 are connected at their upper ends to and support a platform 8. The platform 8, in this embodiment, is made up of side beams 12, and end beams 14. The end beams and side beams define a rectangular opening 15. The side beams, extending from a leading end 9 of the structure to a trailing end 10, are longer than the end beams. The posts 5 are secured to and made rigid with respect to the platform by gusset plates 18 and diagonal braces 20.

A trailing end cross beam 21, secured between the posts 5 at the trailing end 10, has connected to it transversely spaced coupling plates 24. Clevis plates 26 are welded to the end beam 14 above the trailing end cross beam 24, as shown particularly in FIG. 3.

Figure 2:
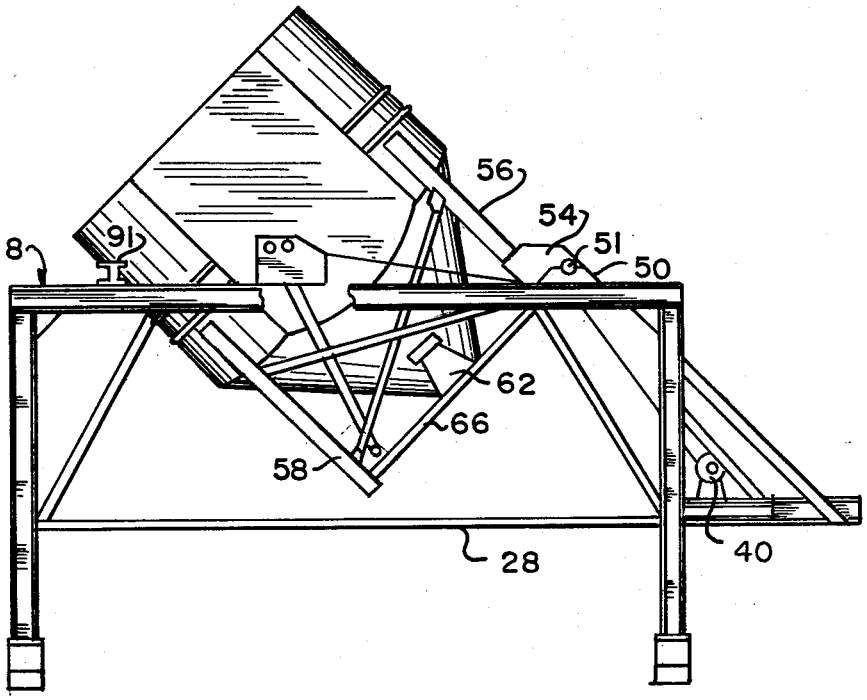
FIG. 2 is a view in side elevation of the silo assembly of FIG. 1 with walkways, lifelines and material conveyor removed, with a silo in a position intermediate an erected position and a transport postiion.

In its transport mode, the assembly is provided with a transport channel 28, mounted at its two ends on posts 5 between the leading and trailing ends of the structure, as shown in FIG. 2. The transport channel 28 is merely to give additional bracing against spreading of the posts 5 with respect to one another in transport, and is removed when the device is in its erected, operating condition as shown in FIG. 1, when dump trucks are driven beneath the silo.

Figure 3:
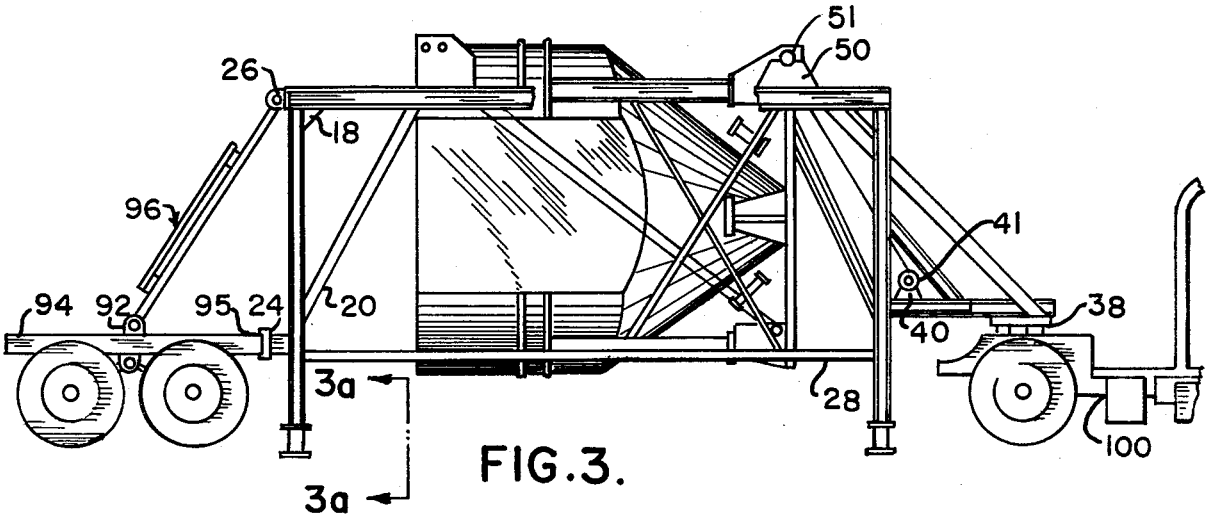
FIG. 3 is a view in side elevation of the silo assembly of FIGS. 1 and 2 in transport condition with jacks in place either to release the wheels or to lower the structure on them.
Figure 3A:
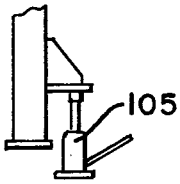
FIG. 3*a* is a fragmentary detail view in elevation taken in the direction of line 3*a*—3*a* of FIG. 3.

In the embodiment shown, the posts are shown as terminating in broad, flat foot plates 31. Jack stands 30 are secured to the posts to accommodate jacks which are used to lift the entire assembly, as indicated in FIGS. 3 and 3*a*.

A leading end frame 32 is connected to the leading end of the structure. The leading end frame has a tongue section 33, to which heavy diagonal frame braces 34 are secured at one end and secured to the end beam 14 and side beams 12 at their other end, as indicated in FIGS. 1–3.

The leading end frame 32 includes a winch-support section 35, from which stiffeners 36 extend to the posts 5 adjacent them, as best shown in FIG. 1.

The tongue section 33 carries on its underside a fifth wheel plate or shoe 38. The winch support section carries a winch 40 with a cable-receiving drum 41.

Mounted on the upper surface of the side beams 12, near the leading end of the platform 8, are pillow blocks 50 in which trunions 51 are journaled for rotation. In this embodiment, the trunions 51 are constituted by the ends of a trunion shaft 52 which extends transversely of the platform, as shown in FIG. 1 and as indicated somewhat diagrammatically in FIG. 4.

The trunion shaft is secured to and carries a pair of box-form connectors 54, which in turn are secured to and carry transversely spaced leading end stanchions 56 secured at their outer ends to the silo 3. A pair of transversely spaced trailing end stanchions 58 are secured to the silo 3 at an outer end, and are connected at their lower ends, by means of wing plates 68, to a stanchion cross beam 69, as shown somewhat diagrammatically in FIG. 4. The trailing end stanchions are braced by cross braces and diagonal braces 66 connecting one another and connecting them with the leading end stanchions 56. A heavy angle-shaped support block stand 64 extends transversely of the platform between the trailing end stanchions, as shown particularly in FIGS. 5 and 6.

In the embodiment shown, the silo 3 has an open top, a gated bottom opening 62, and flat sides 63. The flat sides 63 are provided to accommodate the particular dimensions of the opening 15 in the platform 8. Stop members 67 are shown as projecting transversely from the silo. The stop members 67 rest upon the upper surface of the side beams 12 when the silo is in its transport position, to support the silo. They are suitably braced and secured.

A series of pulleys is provided, each housed in an appropriate protective housing. In this embodiment, a leading end pulley 70 is mounted on the side beam 12 adjacent the pillow block 50 on the left side of the platform, as viewed in FIG. 1, or right side as viewed in FIG. 4. A second pulley 71 is mounted on the same side beam toward the trailing end 10. A first transverse pulley 72 is mounted on the stanchion cross beam 69 at its end nearest the pulley 71. A second transverse pulley 73 is mounted near the other end of the stanchion cross beam 69. A far pulley 74 is mounted on the other side beam 12. A first transverse return pulley 75 is mounted near the ends of the stanchion cross beam adjacent the far pulley 74. A second transverse return pulley 76 is mounted at the other end of the stanchion cross beam 69. An anchor pin 79 is fixedly mounted on an anchor pin bracket on and above the side beam 12 at a point nearer the trailing end 10 than the second pulley 71, but at substantially the same height as the upper effective radius of the pulley 71.

A cable 90 is fastened at one of its ends to the drum 41. The cable 90 extends from the drum 41 over the leading end pulley 70, over the second pulley 71, around the first transverse pulley 72, along the stanchion cross beam 69, around the second transverse pulley 73, around the far pulley 74, beneath the first transverse return pulley 75, around the second transverse pulley 76, to the anchor pin 79 to which its other end is secured.

Figure 6:
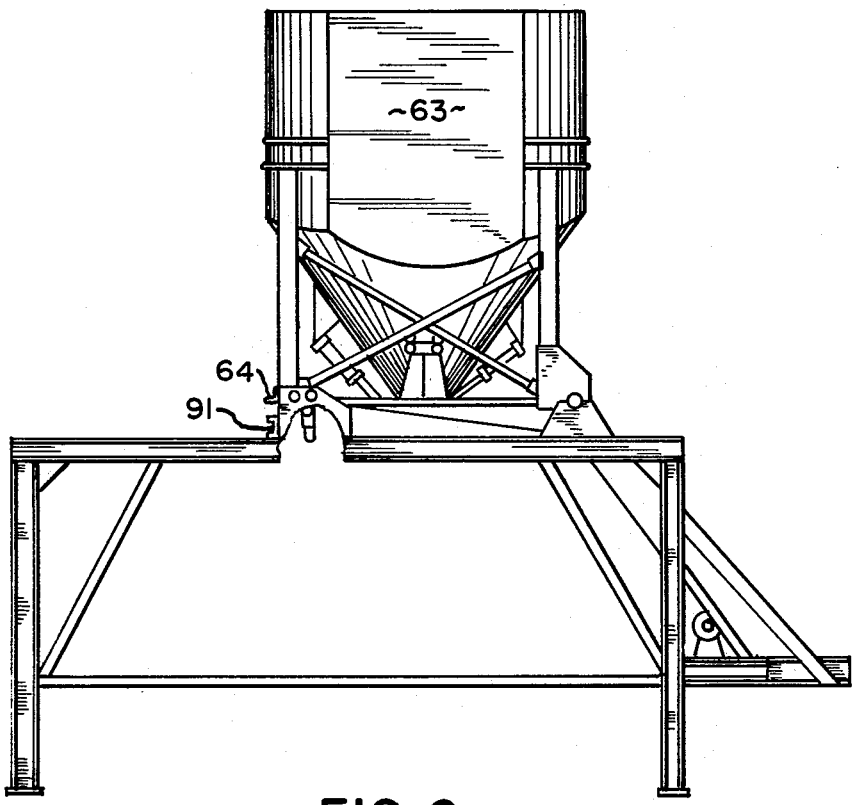
FIG. 6 is a view in side elevation, partly broken away, of the silo in its erected position.

The silo is held in its erected position by an I-beam support block 91, upon which the support block stand 64 rests, as shown in FIG. 6. The I-beam support block 91, which can be a separate block on each side beam, is moved out of the way to permit the silo to be moved to and from its transport position.

In the transport position and condition, the structure is mounted at its leading end on the fifth wheel of a tractor 100, which engages the shoe or plate 38, and at its trailing end is mounted on a tandem wheeled trailer 94. The tandem wheeled trailer 94 is connected to the structure by means of coupling plates 95 secured to a projecting end of parallel bed beams directed fore and aft, connected, as by bolting, to the coupling plates 24, and a cross braced thrust frame 96, hingedly mounted at one end on knuckles 97 secured to the bed beams of the trailer 94, and hingedly mounted at its other end to the clevis plates 26 secured to the trailing end beam 14.

In operation, the structure, with the silo in its transport position as shown in FIG. 3, and with the transport channel 28 bolted in place, is jacked up by means of jacks 105, high enough to permit the tractor 101 to be backed under the tongue section 33 and linked with the fifth wheel shoe 38, and to permit the alignment of the trailer coupling plates 95 with the coupling plates 24 and their being bolted, and the ends of the thrust frame 96 to be connected to the knuckles 97 and to the clevis plates 26 by means of clevis pins. The jacks are then lowered and removed, and the structure transported by the tractor to its operating site. At the site, the structure is jacked up far enough to permit the tractor to be disconnected and the trailer and thrust frame to be disconnected, and the jacks are then lowered to permit the structure to rest on the broad, flat foot pads 31.

Figure 4:
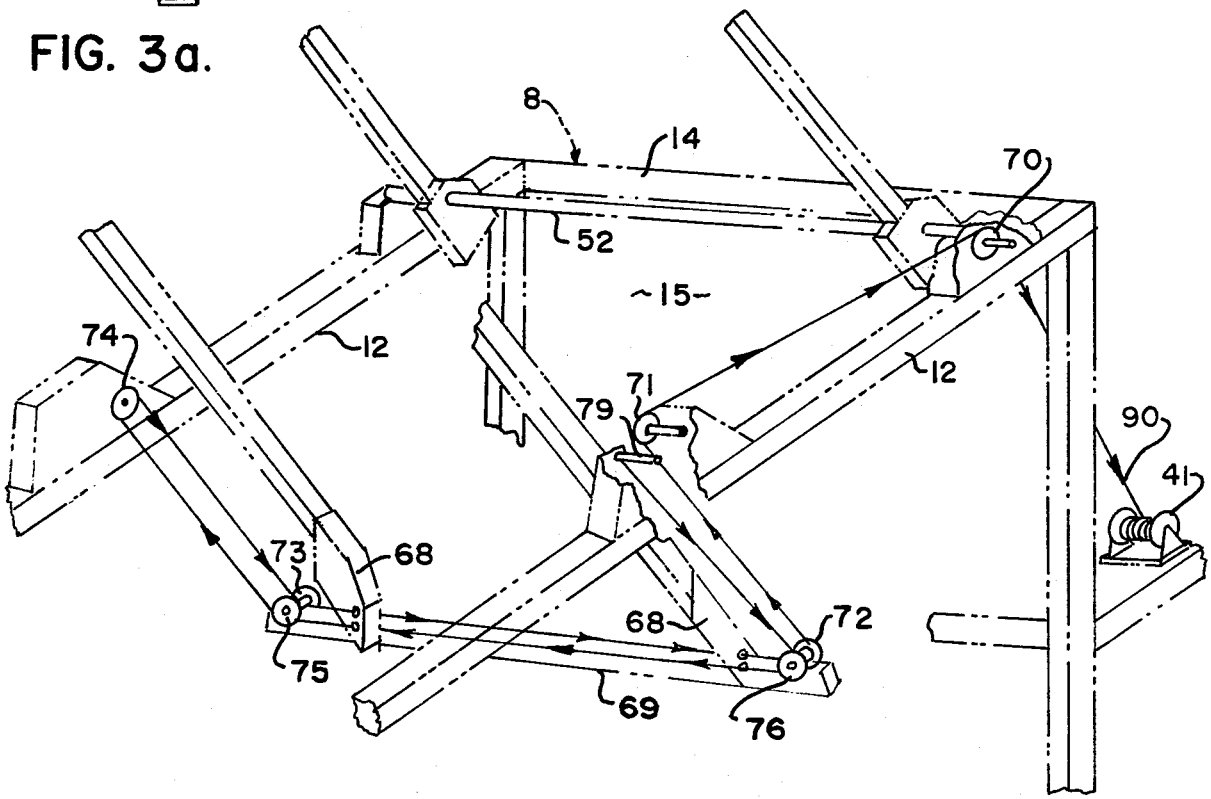
FIG. 4 is an isometric view somewhat diagrammatic in nature, showing the arrangement of cable in the preferred embodiment.
Figure 5:
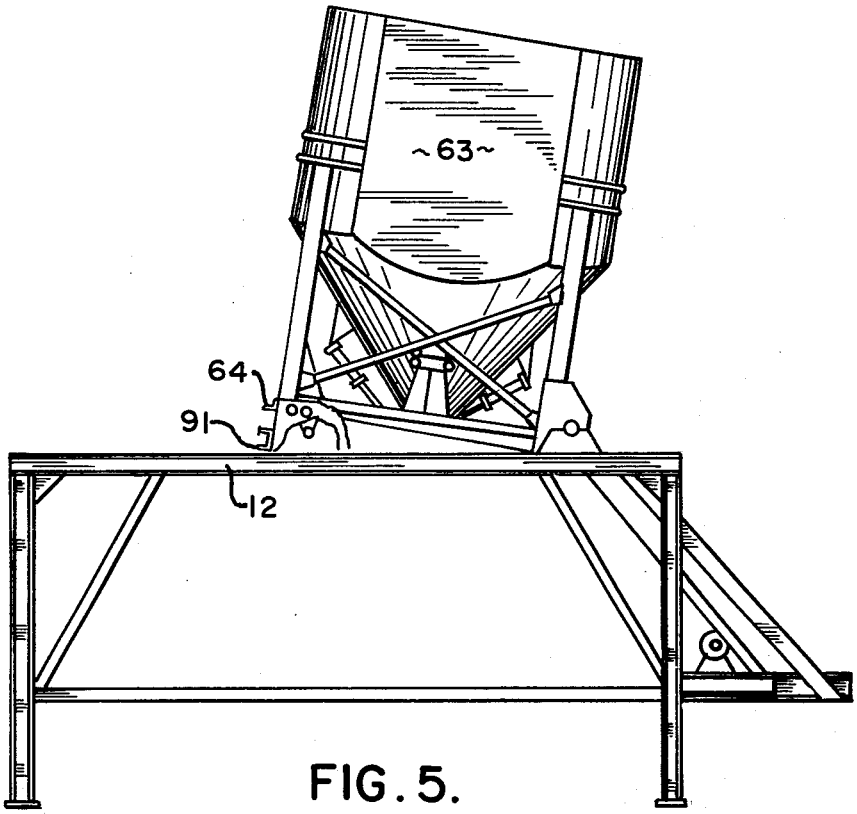
FIG. 5 is a view in side elevation, partly broken away, showing the silo in the process of erection.

The winch drum is then rotated as indicated in FIG. 4, to tighten the cable and wind it on the drum 41, thereby raising the silo through the intermediate station shown in FIG. 2, to a position beyond the position at which the silo is to be used, as shown in FIG. 5. The support block or blocks 91 are placed in position as shown in FIG. 5, and the cable is slacked off enough to permit the silo to come to rest on the block or blocks 91. A temporary walkway 105 with suitable guard rails 106 can be erected at the level of the beams 12 and 14, and a guard rail 107 can be erected around the top of the tank which, while open, may have a walkway extending inwardly part way along at least three sides. A suitably braced conveyor 110 can be mounted at its upper end on the silo, to permit loading of the silo from the ground. The conveyor, walkways, and guard rails are conventional and form no part of the invention.

In moving the silo to a different location, the recited steps are performed in the reverse order, as appropriate.

Numerous variations in details of construction, such as the bracing, shape and dimensions of the various components, with the scope of the appended claims, will occur to those skilled in the art in the light of the foregoing disclosure.

Having thus described the invention, what is claimed and desired to be secured by Letters Patent is:

1. A transportable storage and dispensing silo assembly comprising a self-supporting structure including spaced supporting posts and a platform connected to and supported by said posts, said platform having laterally spaced side members and longitudinally spaced end members connecting said side members and defining an opening in said platform; bearing means mounted on and extending above said side memebers; trunions, journaled in said bearing means; a silo, mounted on said trunions for pivotal movement between an erected position wholly above said platform and a lowered, transport position at least partly within the said platform opening, means mounted on said structure for moving said silo between erected and lowered positions, and means for selectively mounting said structure on and demounting said structure from wheels whereby said structure can be transported.

2. The device of claim 1 wherein the said silo has a support frame at least a part of which is at a position remote from said trunions and said means for moving said silo consists of a winch and a single cable, connected at one end to said winch and extending beneath and mounted to lift said silo support frame part when said cable is wound on said winch.

3. The device of claim 1 wherein the said supporting posts are of a height such that they support said silo in its erected position a distance from the ground sufficient to permit a self-propelled dump truck to drive beneath the silo for loading, and, in the transporting condition, longitudinally extending side members are mounted between said legs intermediate the vertical ends of the said posts.

4. The device of claim 1 wherein said silo has a support frame a part of which is at a position remote from said trunions, the said trunions support said silo during its use in its erected position at one end lengthwise of said platform and removable blocking means is provided between said silo support frame and said platform, said blocking means resting upon said platform and said silo support frame resting upon said blocking means to support said silo on said support frame part.

5. A transportable storage and dispensing silo assembly comprising a self-supporting structure including spaced supporting posts and a platform connected to and supported by said posts, said platform having laterally spaced side members and longitudinally spaced end members connecting said side members and defining an opening in said platform; bearing means mounted on said side members; trunions, journaled in said bearing means; a silo having a support frame at least a part of which is at a position remote from said trunions, mounted on said trunions for pivotal movement between an erected position and a lowered; transport position at least partly within the said opening, means mounted on said structure for moving said silo between erected and lowered positions, said means for moving said silo comprising a winch and cable, connected at one end to said winch and extending beneath and mounted to lift said silo support frame part when said silo is mounted on said winch, said cable extending lengthwise of said platform in a single reach from said winch to and around a pulley mounted on said platform at a place remote from said trunions, thence to and around a pulley mounted on said silo support frame part, thence transversely of said platform and silo support frame to and around a second pulley mounted on said silo frame support part, thence to and around a pulley on said platform, thence to and around a pulley on said silo support frame part, thence back, transversely of said platform and silo support frame to and around another pulley mounted on said silo support frame part, thence to an anchor on said platform; and means for selectively mounting said structure on and demounting said structure from wheels whereby said structure can be transported.

* * * * *